United States Patent [19]

Contreras

[11] 4,331,357

[45] May 25, 1982

[54] ROLLER SKATE TOTE

[76] Inventor: Robert A. Contreras, 2305 Curtis Ave., Redondo Beach, Calif. 90278

[21] Appl. No.: 191,262

[22] Filed: Sep. 26, 1980

[51] Int. Cl.[3] ..... A47F 7/08; B65D 71/00

[52] U.S. Cl. ..... 294/145; 12/120.5; 24/204; 211/34; 224/901; 280/811; 294/148; 294/159; 294/165; 294/166

[58] Field of Search ..... 24/204, 901; 224/901, 224/246, 247, 251, 249, 252, 250, 917; 220/94 A; 206/151, 315 R, 477, 478, 479, 480, 481; 294/145, 147, 146, 159, 162, 165, 166, 27 R, 148; 280/809, 811, 814, 815; 248/187, 316 D; 211/34, 37; 12/120.5

[56] References Cited

U.S. PATENT DOCUMENTS

| | | | |
|---|---|---|---|
| D. 180,901 | 9/1957 | Glazer | D9/334 |
| 2,353,809 | 7/1944 | Carson | 294/165 |
| 2,524,639 | 10/1950 | Saunders | 224/250 X |
| 2,703,651 | 3/1955 | Brocklehurst | 211/34 |
| 3,154,281 | 10/1964 | Frank | 248/316 D |
| 3,158,284 | 11/1964 | Henchert et al. | 220/94 A X |
| 3,909,718 | 9/1975 | Allsop et al. | 294/162 |
| 4,063,704 | 12/1977 | Rother | 24/204 X |
| 4,126,256 | 11/1978 | McGruder | 206/315 R X |

*Primary Examiner*—Allan N. Shoap
*Attorney, Agent, or Firm*—Roger A. Marrs

[57] ABSTRACT

A tote apparatus or carrier for a pair of roller skates is disclosed herein having a central body member provided with identical skate securements carried on its opposite ends. Each securement includes a pair of releasable holders for retaining and supporting the wheels of the roller skates intended to be carried. A handle is provided across the central body member so that the weight of the roller skates is substantially and evenly distributed. The holders may include resilient snap-lock devices, flexible straps employing Velcro or latch mechanism utilizing clamps.

1 Claim, 4 Drawing Figures

ROLLER SKATE TOTE

BACKGROUND OF THE INVENTION

1. Field of the Invention

This invention relates to carrier devices and more particularly to a novel tote or carrier for holding a pair of roller skates in releasable securement so that the skates may be readily transported from one place to another in a convenient manner.

2. Brief Description of the Prior Art

In the past, it has been the conventional practise to carry roller skates under the arm of the user similar to a person carrying a bundle or the shoestrings or the straps of the skates are tied together and the arrangement is placed around the skater's neck so that his hands are free. Obviously, difficulties and problems stem from this prior practise which are due to the bulk and weight of a pair of roller skates as well as to their awkward configuration. Some attempts have been made to provide a variety of cases or boxes which include pivoting hinges and elaborate tie down arrangements for securing the pair of skates therein. Such a practise only adds to the weight of the pair of skates and further adds to the overall size and awkwardness for carrying from place to place. Such a prior box or container is readily suitable for storage of the roller skates but is not particularly desirable for transporting or carrying the skates from one place to another.

Therefore, it has been a long standing need to provide a novel means for carrying and transporting a pair of roller skates from one place to another which is convenient not only from a size and weight viewpoint but from a securement consideration whereby the skates may be readily released from retention to the device or carrier.

SUMMARY OF THE INVENTION

The above problems and difficulties are obviated by the present invention which provides a novel tote or carrier for releasably holding a pair of roller skates while the skates are being carried from place to place. The tote or carrier comprises an elongated central body member which is provided with roller skate carriers at each end of the member. The carriers include securement means for releasably or detachably holding a pair of roller skates to the central body member. Each of the securement or holding means includes circular retaining means adapted to receive a wheel from the skates in such a manner that the wheel may be readily snap-locked into position, clamped into position or retained in position by straps.

In one form of the invention, semi-circular resilient elements outwardly extend from the central base member so that their free ends are in fixed spaced apart relationship whereby the free ends may be readily spread apart to snap-lock over the wheel of the skate. A handle is provided by attachment to the opposite ends of the central body member so that the weight of the pair of skates is evenly distributed and so that the assemblage may be readily carried from one place to another.

Therefore, it is among the primary objects of the present invention to provide a novel tote or carrier for a pair of roller skates which includes means for releasably holding the wheels of the skate to the tote or carrier.

Another object of the present invention is to provide a novel tote or carrier for a pair of roller skates which releasably retains the skates to a handle without necessitating the need for a box, container or other structure into which the pair of skates are placed.

Still another object of the present invention is to provide a new and novel tote or carrier for a pair of roller skates which will readily attach to the wheels of the skates and which includes a handle for evenly distributing the weight of the skates to the tote or carrier attached to the handle.

Still a further object of the present invention is to provide a novel means including resilient fasteners for detachably connecting to the wheels of the pair of roller skates so that the skates may be readily transported from one place to another with ease and convenience.

BRIEF DESCRIPTION OF THE DRAWINGS

The features of the present invention which are believed to be novel are set forth with particularity in the appended claims. The present invention, both as to its organization and manner of operation, together with further objects and advantages thereof, may best be understood by reference to the following description, taken in connection with the accompanying drawings, in which:

DESCRIPTION OF PREFERRED EMBODIMENT

Figure 1:
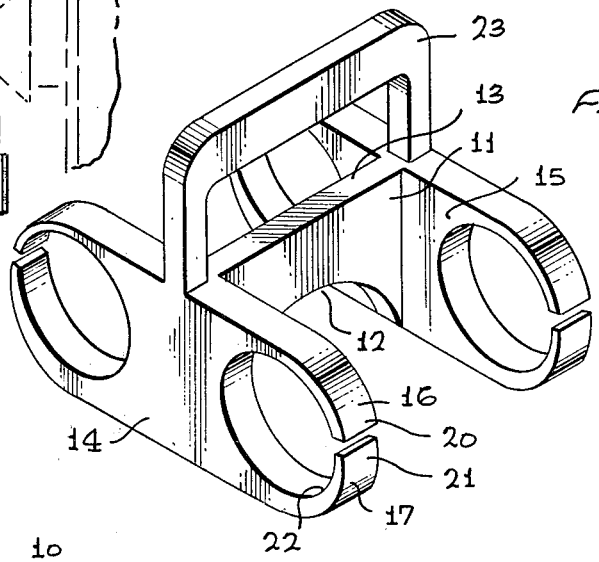
FIG. 1 is a front perspective view of the novel tote or carrier of the present invention incorporating resilient snap-lock means for releasably holding the wheels of a pair of roller skates.

Referring to FIG. 1, the novel tote or carrier apparatus of the present invention is illustrated in the general direction of arrow 10 which includes a central body member 11 having a lower edge 12 formed in a semicircular configuration so as to provide strength to the member. A top surface 13 is flat. The opposite ends of the central body member 12 are provided with elongated securement means for holding onto the rear wheels of a pair of roller skates and each securement means is indicated by numerals 14 and 15 respectively. The securement means 14 and 15 are understood to be identical in configuration and construction.

Referring to securement means 14 by way of explanation, it can be seen that the securement means includes a releasable connector or holding means on each of its opposite ends which are intended to releasably hold or retain a wheel associated with the roller skates. Such a connector or holding means may take the form of a pair of semi-circular elements 16 and 17 which are integrally formed at one end with the main portion of the arrangement means 14 while the free ends thereof terminate in spaced apart relationship and are indicated by numerals 20 and 21 respectively. For insertion of a wheel into the circular opening defined by the semi-circular elements 16 and 17 as well as a semi-circular cutout 22 carried on the main body of the means 14, the elements 16 and 17 as well as their ends 20 and 21 are spread apart manually and the round wheel is inserted into the opening so that upon release of the elements, the ends 20 and 21 will snap thereon.

The opening defined by the circular wall surface associated with portion 22 and elements 16 and 17 is round and of substantially the same diameter as a roller skate wheel. Although size is not critical, it is to be understood that the opening is substantially occupied by the round wheel and that the opening corresponds in configuration to the external shape of the roller skate wheel.

For convenience in carrying, a handle 23 is provided which is of substantially u-shaped configuration having its opposite ends integrally formed at the juncture of the central body member 11 with the opposite securement means 14 and 15. By the user grasping the handle, the weight of the carrier with the pair of roller skates is substantially balanced and the weight is evenly distributed. Not only does the arch or semi-circular cutout 12 provide reinforcement for the central body member 11, but the handle 23 also provides additional strength and rigidity to the unit.

Figure 2:
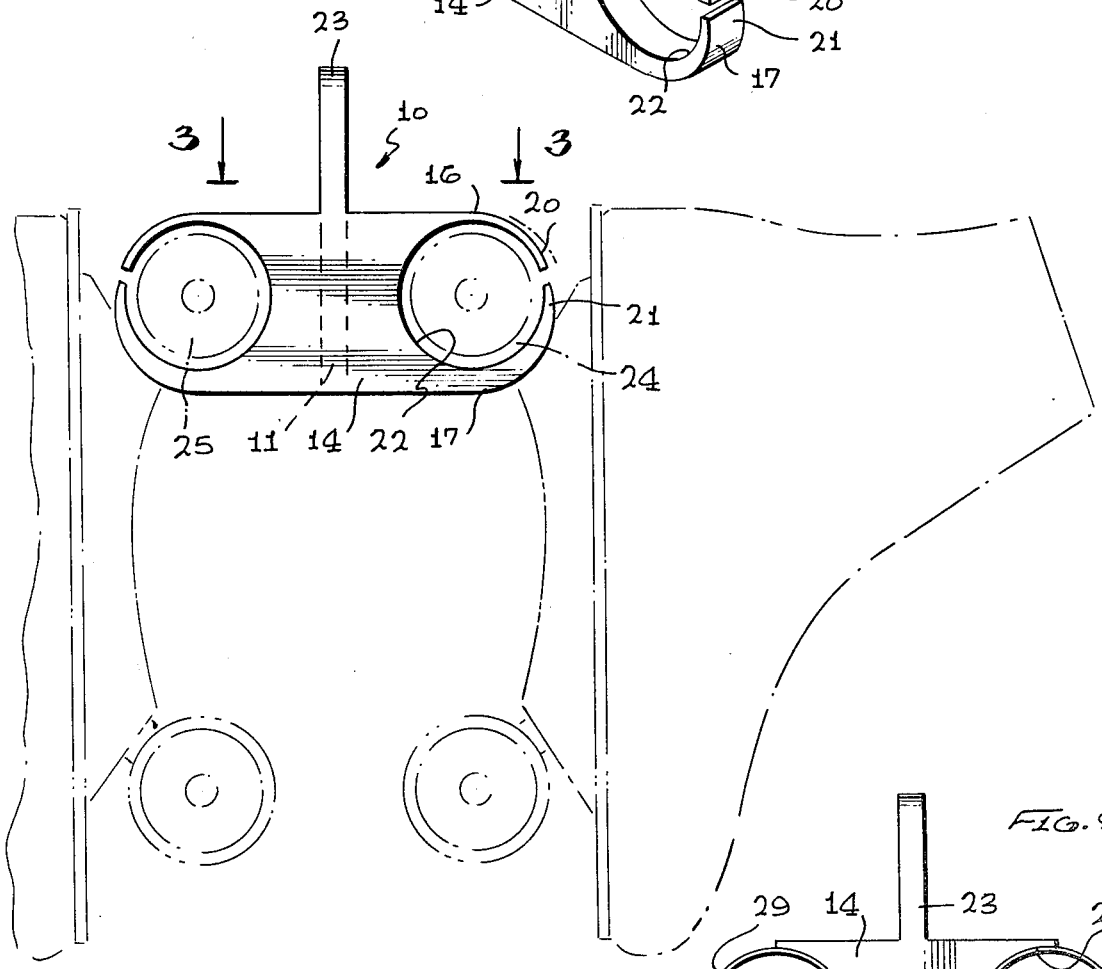
FIG. 2 is a side elevational view of the novel tote or carrier shown in FIG. 1 illustrating the roller skates in broken lines.

As shown more clearly in FIG. 2, the rear wheels of each shoe skate represented by numerals 24 and 25 are carried on each of the securement means holders. The flexibility of the element 16 is indicated in broken lines in order to insert or remove wheel 24 from the circular opening provided therein. In broken lines, the element is shown in its normally biased position pressing against the wheel 24.

Figure 3:
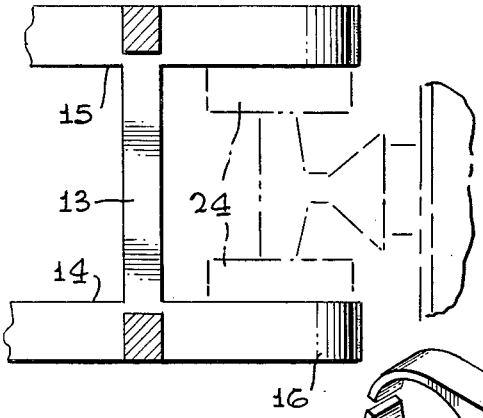
FIG. 3 is a transverse sectional view of the tote or carrier shown in FIG. 2 as taken in the direction of arrows 3—3 thereof.

In FIG. 3, it can be seen that a pair of rear wheels from one shoe skate is held by a pair of holders or retainers on one side of the central body member 12. Therefore, it is understood that the retaining means 14 and 15 are normal or perpendicular to the central body member 12.

Therefore, it can be seen that a pair of roller skates may be easily transported from one place to another by inserting the rear wheels of each skate into the respective securement means associated on each side of the central body member 11. The wheels may be readily snap-locked into holding relationship by spreading the elements 16 and 17 apart so as to provide an enlarged opening into which a respective wheel may be inserted. Once the wheel has been inserted in the opening, the elements 16 and 17 may be released so that their normal bias will cause the elements to engage with the outer surface of the wheel.

Figure 4:
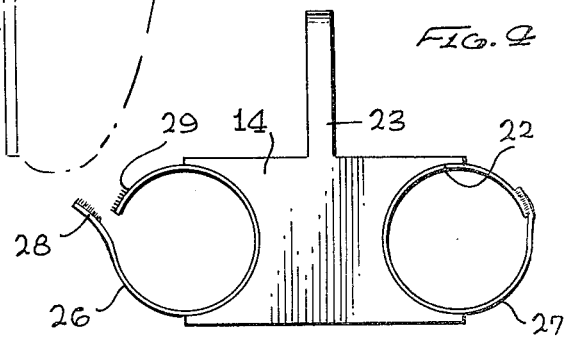
FIG. 4 is a side elevational view of another embodiment of the present invention incorporating a modified releasable retaining means for detachably connecting with the wheels of a pair of roller skates.

Another embodiment of the present invention is shown in FIG. 4 wherein the elements 16 and 17 have been replaced by a Velcro strap indicated by numeral 26 associated with one side of the securement means and by numeral 27 associated with the other side. The strap 26 includes a hook and pile fastener indicated by numerals 28 and 29 and strap 26 is illustrated in its open position available for receiving an associated wheel. Once the wheel has been inserted into the semi-circular cutout associated with the securement means 14, the strap is then extended about the wheel and secured. The strap 27 is illustrated in its secured position so that the hook and pile fastener associated therewith is in engagement. Each strap, such as strap 27 is adhesively secured to its associated semi-circular surface 22 carried on the securement means 14.

In addition to the snap-lock fastening means 16 and 17 and to the straps 26 and 27, it is to be understood that a clamp type fastener, holder or retaining means may be provided wherein a C-shaped clamp may be readily attached by screws, latches or snaps may also be employed for retaining the roller skate wheels onto the retaining means.

While particular embodiments of the present invention have been shown and described, it will be obvious to those skilled in the art that changes and modifications may be made without departing from this invention in its broader aspects and, therefore, the aim in the appended claims is to cover all such changes and modifications as fall within the true spirit and scope of this invention.

What is claimed is:

1. A tote apparatus for carrying a pair of roller skates comprising the combination of:

an elongated central body member;

securement means carried on the opposite ends of said central body member and extending normal thereto;

said securement means having holding means at respective ends thereof;

each of said holding means incorporating releasable means for selective retaining engagement with a wheel of the roller skate;

said releasable means includes a circular opening for insertably receiving said wheel and said opening is partially defined by a pair of curved elements extending from opposite sides of a semicircular portion so that their ends terminate in spaced apart relationship;

said curved elements are pliable so as to be flexed to snap-lock in engagement with said wheel;

said securement means and said central body member are integrally formed to provide a unitary juncture construction;

said central body member includes lower and upper edges reinforced by having its lower edge curved to form an arch and its upper edge flat in a linear construction; and a U-shaped handle having opposite ends joined with said juncture construction of said central body member with said securement means at an area mid-way between said respective ends of said securement means.

* * * * *